US007554781B1

(12) United States Patent
Weeks et al.

(10) Patent No.: US 7,554,781 B1
(45) Date of Patent: Jun. 30, 2009

(54) PROTECTIVE DEVICE WITH AN AUXILIARY SWITCH

(75) Inventors: Richard Weeks, Little York, NY (US); Gerald R. Savicki, Jr., Canastota, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 263 days.

(21) Appl. No.: 11/109,579

(22) Filed: Apr. 19, 2005

Related U.S. Application Data

(63) Continuation-in-part of application No. 10/901,688, filed on Jul. 29, 2004, now Pat. No. 7,312,782.

(51) Int. Cl.
*H01H 73/02* (2006.01)

(52) U.S. Cl. ..... 361/42; 335/6; 335/15; 335/18; 335/21; 335/22

(58) Field of Classification Search ..... 335/6, 335/21, 24, 25, 13, 15, 18, 22; 361/42–50
See application file for complete search history.

(56) References Cited

U.S. PATENT DOCUMENTS

| | | | | |
|---|---|---|---|---|
| 4,034,266 A | | 7/1977 | Virani et al. | |
| 4,114,123 A | * | 9/1978 | Grenier | 335/42 |
| 4,442,470 A | | 4/1984 | Misencik | |
| 4,595,894 A | * | 6/1986 | Doyle et al. | 335/18 |
| 4,618,907 A | | 10/1986 | Leopold | |
| 5,202,662 A | | 4/1993 | Bienwald et al. | |
| 6,180,899 B1 | * | 1/2001 | Passow | 200/243 |
| 6,720,510 B2 | * | 4/2004 | Passow | 200/243 |

FOREIGN PATENT DOCUMENTS

CN 200510007239.2 8/2006

* cited by examiner

*Primary Examiner*—Ramon M Barrera
(74) *Attorney, Agent, or Firm*—Daniel P. Malley; Bond, Schoeneck & King, PLLC

(57) ABSTRACT

The present invention is directed to a protective device that includes a plurality of line terminals, a plurality of load terminals, and a fault detection assembly coupled to the plurality of line terminals. The fault detection circuit is configured to provide a fault detection output in response to detecting a fault condition. A circuit interrupter is coupled between the plurality of line terminals and the plurality of load terminals. The circuit interrupter includes a first set of contacts, the first set of contacts being configured to close to establish at least one electrically continuous path between the plurality of line terminals and the plurality of load terminals in a reset state. The first set of contacts are also configured to open to disconnect the at least one electrically continuous path in response to the fault detection output to enter a tripped state. An auxiliary switch is coupled to the fault detection assembly. The auxiliary switch includes a second set of contacts configured to decouple at least a portion of the fault detection assembly from a source of electrical power in the tripped state. A latch assembly is coupled to the circuit interrupter. The latch assembly includes a first latch block mechanism configured to close the first set of contacts in the reset state and a second latch block mechanism configured to open the second set of contacts in the tripped state.

53 Claims, 6 Drawing Sheets

PROTECTIVE DEVICE WITH AN AUXILIARY SWITCH

CROSS-REFERENCE TO RELATED APPLICATIONS

This is a continuation-in-part of U.S. patent application Ser. No. 10/901,688 filed on Jul. 29, 2004, now U.S. Pat. No. 7,312,782 the content of which is relied upon and incorporated herein by reference in its entirety, and the benefit of priority under 35 U.S.C. §120 is hereby claimed.

BACKGROUND OF THE INVENTION

1. Field of the Invention

The present invention relates generally to electrical wiring devices, and particularly to electrical wiring devices including protective features.

2. Technical Background

AC power is coupled to an electrical distribution system at a breaker panel. The breaker panel is disposed within a residence, commercial building or some other such facility. The breaker panel distributes AC power to one or more branch electric circuits installed in the structure. The electric circuits may typically include one or more receptacle outlets and may further transmit AC power to one or more electrically powered devices, commonly referred to in the art as load circuits. The receptacle outlets provide power to user-accessible loads that include a power cord and plug, the plug being insertable into the receptacle outlet. However, certain types of faults have been known to occur in electrical wiring systems. Accordingly, each electric circuit typically employs one or more electric circuit protection devices.

Electric circuit protective devices may be disposed within the breaker panel, receptacle outlets, plugs and the like. Both receptacle wiring devices and electric circuit protective wiring devices are disposed in an electrically non-conductive housing. The housing includes electrical terminals that are electrically insulated from each other. In particular, line terminals couple the wiring device to conductors coupled to the breaker panel. Load terminals are coupled to wiring that directs AC power to one or more electrical loads. Those of ordinary skill in the pertinent art will understand that the term "load" refers to an appliance, a switch, or some other electrically powered device.

Load terminals may also be referred to as "feed-through" terminals because the wires connected to these terminals may be coupled to a daisy-chained configuration of receptacles or switches. The load may ultimately be connected at the far end of this arrangement. Referring back to the device housing, the load terminals may be electrically connected to a set of receptacle contacts. The receptacle contacts are in communication with receptacle openings disposed on the face of the housing. This arrangement allows a user to insert an appliance plug into the receptacle opening to thereby energize the device.

Protective devices employ a circuit interrupter disposed between the line terminals and the load terminals. The circuit interrupter provides power to the load terminals under normal conditions, but breaks electrical connectivity when the protective device detects a fault condition in the load circuit.

There are several types of electric circuit protection devices including ground fault circuit interrupters (GFCIs), ground-fault equipment protectors (GFEPs), and arc fault circuit interrupters (AFCIs). This list includes representative examples and is not meant to be exhaustive. Some devices include both GFCIs and AFCIs. As their names suggest, arc fault circuit interrupters (AFCIs), ground-fault equipment protectors (GFEPs) and ground fault circuit interrupters (GFCIs) perform different functions.

An arc fault typically manifests itself as a high frequency current signal. Accordingly, an AFCI may be configured to detect various high frequency signals and de-energize the electrical circuit in response thereto. A ground fault occurs when a current carrying (hot) conductor creates an unintended current path to ground. A differential current is created between the hot/neutral conductors because some of the current flowing in the circuit is diverted into the unintended current path. The unintended current path represents an electrical shock hazard. Ground faults, as well as arc faults, may also result in fire.

A "grounded neutral" is another type of ground fault. This type of fault may occur when the load neutral terminal, or a conductor connected to the load neutral terminal, becomes grounded. While this condition does not represent an immediate shock hazard, it may lead to serious hazard. As noted above, a GFCI will trip under normal conditions when the differential current is greater than or equal to approximately 6 mA. However, when the load neutral conductor is grounded the GFCI becomes de-sensitized because some of the return path current is diverted to ground. When this happens, it may take up to 30 mA of differential current before the GFCI trips. Therefore, if a double-fault condition occurs, i.e., if the user comes into contact with a hot conductor (the first fault) when simultaneously contacting a neutral conductor that has been grounded on the load side (the second fault), the user may experience serious injury or death.

However, a protective device, like all electrical devices, has a limited life expectancy. This poses a problem in that when the device has reached end of life, the user may not be protected from the fault condition. End of life failure modes include failure of device circuitry, the circuit interrupter that opens (trips) the GFCI interrupting contacts, the relay solenoid that opens the GFCI interrupting contacts, and/or the solenoid switching device. Switching devices include thyristors such as the silicon controlled rectifiers (SCRs). An end of life failure mode can result in the protective device not protecting the user from the faults referred to above.

In one approach that has been considered, a test buttons is incorporated into a protective device to provide the user with a means for testing the effectiveness of the device. One drawback to this approach lies in the fact that if the user fails to use the test button, the user will not know if the device is functional. Even if the test is performed, the test results may be ignored by the user for various reasons.

What is needed is a protective device that denies power to the protected circuit when the device is non-protective. What is needed is a protective device that denies power to the protected circuit when the SCR is experiencing an end of life condition. What is needed is an auxiliary switch designed to have an improved reliability.

SUMMARY OF THE INVENTION

The present invention is directed to a protective device that denies power to an electric circuit when the device loses its protective functionality. In particular, the protective device of the present invention denies power to the protected circuit when the SCR is experiencing an end of life condition. The present invention accomplishes the power denial using an auxiliary switch designed to have an improved reliability.

One aspect of the present invention is directed to a protective device that includes a plurality of line terminals, a plurality of load terminals, and a fault detection assembly coupled to the plurality of line terminals. The fault detection circuit is configured to provide a fault detection output in response to detecting a fault condition. A circuit interrupter is coupled between the plurality of line terminals and the plurality of load terminals. The circuit interrupter includes a first set of contacts, the first set of contacts being configured to close to establish at least one electrically continuous path between the plurality of line terminals and the plurality of load terminals in a reset state. The first set of contacts are also configured to open to disconnect the at least one electrically continuous path in response to the fault detection output to enter a tripped state. An auxiliary switch is coupled to the fault detection assembly. The auxiliary switch includes a second set of contacts configured to decouple at least a portion of the fault detection assembly from a source of electrical power in the tripped state. A latch assembly is coupled to the circuit interrupter. The latch assembly includes a first latch block mechanism configured to close the first set of contacts in the reset state and a second latch block mechanism configured to open the second set of contacts in the tripped state.

In another aspect, the present invention is directed to a protective device that includes a plurality of line terminals, a plurality of load terminals, and a fault detection assembly coupled to the plurality of line terminals. The fault detection circuit is configured to provide a fault detection output in response to detecting a fault condition. A circuit interrupter is coupled between the plurality of line terminals and the plurality of load terminals. The circuit interrupter includes a first set of contacts, the first set of contacts being configured to close to establish at least one electrically continuous path between the plurality of line terminals and the plurality of load terminals in a reset state. The first set of contacts are also configured to open to disconnect the at least one electrically continuous path in response to the fault detection output to enter a tripped state. An auxiliary switch is coupled to the fault detection assembly. The auxiliary switch includes a second set of contacts configured to decouple at least a portion of the fault detection assembly from a source of electrical power in the tripped state. A latch assembly is coupled to the circuit interrupter. The latch assembly includes a first latch block mechanism configured to close the first set of contacts in the reset state and a second latch block mechanism configured to open the second set of contacts in the tripped state. A user-accessible reset mechanism is coupled between the circuit interrupter and the latch assembly, the user-accessible reset mechanism being configured to close the first set of contacts and close the second set of contacts in a predetermined sequence.

In yet another aspect, the present invention is directed to a protective device that includes a plurality of line terminals, a plurality of load terminals, and a fault detection assembly coupled to the plurality of line terminals. The fault detection circuit is configured to provide a fault detection output in response to detecting a fault condition. A circuit interrupter is coupled between the plurality of line terminals and the plurality of load terminals. The circuit interrupter includes a first set of contacts, the first set of contacts being configured to close to establish at least one electrically continuous path between the plurality of line terminals and the plurality of load terminals in a reset state. The first set of contacts are also configured to open to disconnect the at least one electrically continuous path in response to the fault detection output to enter a tripped state. An auxiliary switch is coupled to the fault detection assembly. The auxiliary switch includes a second set of contacts that include a moveable contact disposed on a cantilever and a fixed contact disposed on a substantially fixed member. The cantilever is deflected away from the fixed member in an open position to decouple at least a portion of the fault detection assembly from a source of electrical power in the tripped state. A latch assembly is coupled to the circuit interrupter and the auxiliary switch. The latch assembly is configured to deflect the cantilever to the open or closed position.

In yet another aspect, the present invention is directed to a protective device that includes a plurality of line terminals, a plurality of load terminals, and a fault detection assembly coupled to the plurality of line terminals. The fault detection circuit is configured to provide a fault detection output in response to detecting a fault condition. A circuit interrupter is coupled between the plurality of line terminals and the plurality of load terminals. The circuit interrupter includes a first set of contacts, the first set of contacts being configured to close to establish at least one electrically continuous path between the plurality of line terminals and the plurality of load terminals in a reset state. The first set of contacts are also configured to open to disconnect the at least one electrically continuous path in response to the fault detection output to enter a tripped state. An auxiliary switch is coupled to the fault detection assembly. The auxiliary switch includes a second set of contacts that include moveable contacts disposed on a bifurcated cantilever member and fixed contacts disposed on a substantially fixed member. The bifurcated cantilever is deflected away from the fixed member in an open position to decouple at least a portion of the fault detection assembly from a source of electrical power in the tripped state. A latch assembly is configured to deflect the bifurcated cantilever to the closed position wherein one or both of the moveable contacts are in electrical engagement with the corresponding fixed contacts, or to the open position in the tripped state.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
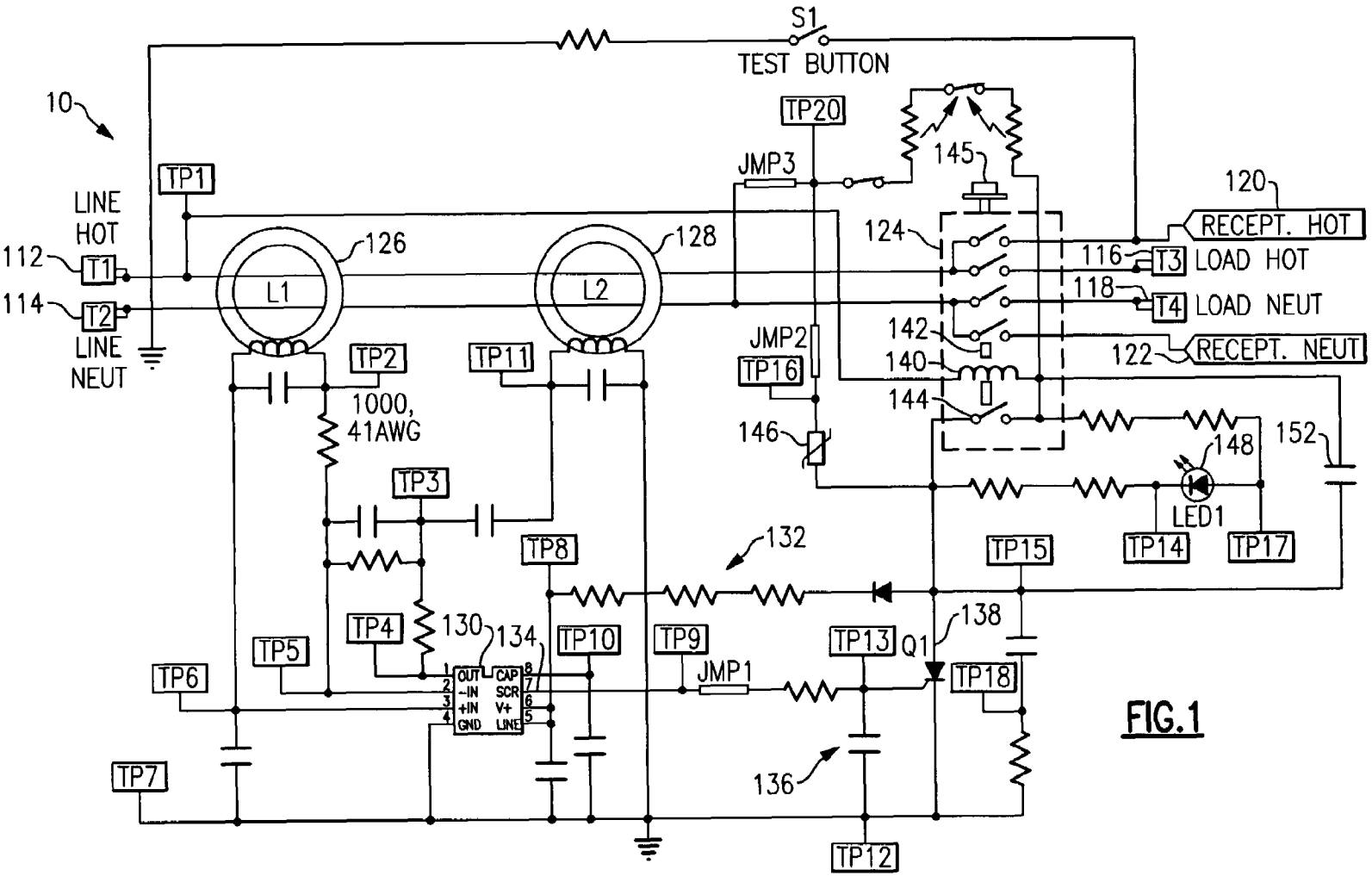
FIG. 1 is a schematic of a circuit protection device in accordance with one embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the protective device of the present invention is shown in FIG. 1, and is designated generally throughout by reference numeral 10.

As embodied herein, and depicted in FIG. 1, a schematic of a circuit protection device 10 in accordance with an embodiment of the present invention is disclosed. GFCI 10 includes ground fault interrupter circuitry. Device 10 includes line terminals 112, 114, load terminals 116, 118, and receptacle terminals 120, 122. Load terminals 116, 118 may also be referred to as feed-through terminals. As noted above, these terminals may be connected to wiring configured to provide power to downstream receptacles or switches. Receptacle load terminals 120,122 are configured to mate with an electrical plug to provide power to an appliance or other such user attachable loads. The line terminals 112, 114 are electrically connected to both load terminals 116, 118 and receptacle terminals 120, 122 when device 10 is reset. When in the tripped state, the circuit interrupter 124 disconnects the load terminals from the line terminals. In addition, the circuit interrupter may disconnect at least one feed-through terminal from a corresponding receptacle terminal.

The ground fault circuitry includes a differential transformer 126 which is configured to sense load-side ground faults. Transformer 128 is configured as a grounded neutral transmitter and is employed to sense grounded-neutral fault conditions. Both differential transformer 126 and grounded-neutral transformer 128 are coupled to detector circuit 130. Power supply 132 provides power for GFI detector circuit 130. Detector 130 provides an output signal on output pin 134 based on the transformer outputs. The detector output signal is filtered by circuit 136. The filtered output signal is provided to the control input of SCR 138. When SCR 138 is turned ON, solenoid 140 is energized. Solenoid 140 actuates the trip mechanism 142 to thereby trip circuit interrupter 124. The trip solenoid 140 is energized until the circuit interrupter trips to remove the fault condition. Accordingly, there is no signal at output 134 and SCR 138 is turned OFF. The time that the solenoid remains energized is less than about 25 milliseconds. After the fault condition has been eliminated, circuit interrupter 124 may be reset by way of reset button 145.

Although FIG. 1 has disclosed a ground fault circuit interrupter circuit, those of ordinary skill in the art will understand that the present invention should not be construed as being limited to GFCIs. The present invention is suitable for use in other types of protective devices. For example, the sensor in an AFCI is similar to transformer 126 but is typically configured to sense load current by way of a toroidal transformer or a shunt and/or line voltage by way of a voltage divider. The detector in an AFCI is similar to detector 130 but is configured to detect an arc fault condition on the basis of frequency spectra or high frequency noise bursts. Once an arc fault condition is detected, a signal is sent in a similar manner to an SCR which in turn activates a trip mechanism to trip the circuit interrupter. Thus the spirit of the invention disclosed herein applies to GFCIs and to protective devices in general.

The present invention addresses certain end of life conditions by denying power when the device is unable to function. One end of life condition may cause the solenoid to be energized when a fault condition is not present, or if the circuit interrupter is in a tripped state. For example, the solenoid is susceptible to burn-out if SCR 138 is permanently ON. The solenoid may also be energized if the SCR 138 is permanently shorted out. Note that most solenoids are configured to be energized only momentarily and burn out if energized for more than about 1 second. Once the solenoid burns out, the circuit interrupter is incapable of being tripped. As a result, the load terminals are permanently connected to the line terminals even when there is a fault condition.

Solenoid burn-out may be prevented by an auxiliary switch 144. Auxiliary switch 144 is configured to open when circuit interrupter 124 is in the tripped position. If SCR 38 is shorted, or is permanently ON, auxiliary switch 144 ensures that solenoid 140 is not permanently connected to a current source. Accordingly, if reset button 145 is activated, circuit interrupter 124 resets but immediately trips in response to the trip mechanism 142, which in turn moves auxiliary switch 144 to the open position before solenoid 140 is able to burn out.

The auxiliary switch 144 affords other electrical benefits. Those of ordinary skill in the art will understand that a metal oxide varistor (MOV) is frequently employed in protective devices to protect the electrical circuit from voltage surges that sometimes occur in the electrical distribution system. The end-of-life failure mode of a MOV is typically an electrical short. The resulting current can be enough to thermally damage the enclosure of the protective device. In one embodiment of the present invention, MOV 146 is connected in series with auxiliary switch 144 and trip solenoid 140 to eliminate any over-current situation. Thus, when MOV 146 reaches end of life and shorts out, trip solenoid 140 is energized to open auxiliary switch 140 and the flow of short circuit current is terminated before any damage ensues.

Another beneficial feature of the present invention is provided by disposing indicator 148 in parallel with auxiliary switch 144. In this embodiment, indicator 148 is implemented as a trip indicator, emitting a visual and/or audible indicator signal when circuit interrupter 124 is in the tripped state, i.e., when the auxiliary switch 144 is open. Of course, indicator 148 provides no such signal when device 10 is in a reset state. Again, indicator 148 may include visual indication, audible indication or both. The indicator may also be configured to emit a repetitive signal (flashing or beeping). A visual indicator may be a flashing red indicator.

Figure 2:
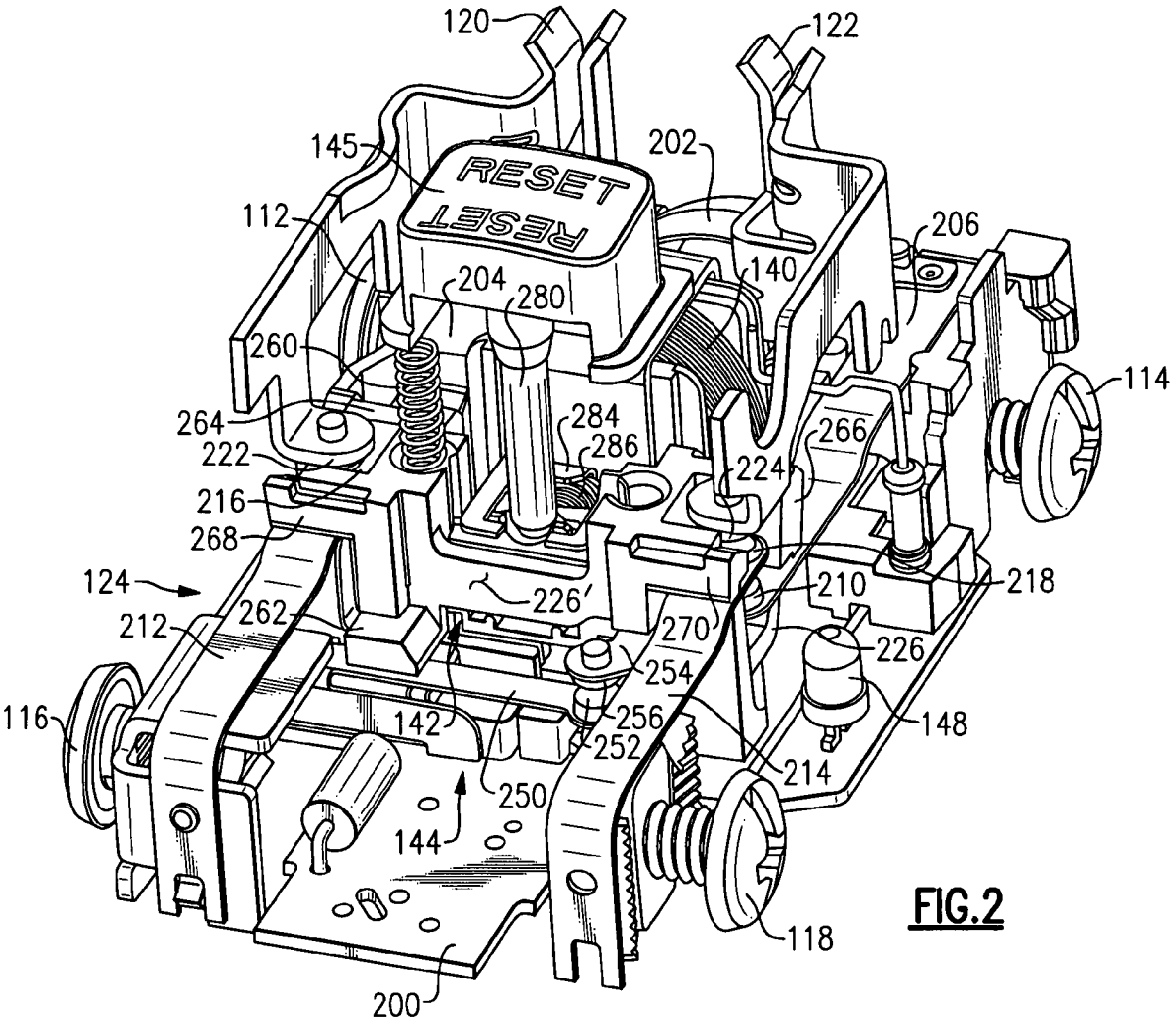
FIG. 2 is a perspective view of a mechanical implementation of the electrical wiring device shown in FIG. 1.

As embodied herein and depicted in FIG. 2, a perspective view of a mechanical implementation of the electrical wiring device shown in FIG. 1 is disclosed. Protective device 10 includes a circuit board 200 which is mounted inside the device housing (not shown). Transformer assembly 202 includes a housing that encloses ground fault transformer 126 and grounded-neutral transformer 128, which are mounted on circuit board 200. Line hot cantilever 204 and line neutral cantilever 206 are connected to line hot terminal 112 and line neutral terminal 114, respectively. The other ends of the cantilevers are connected to contacts 208 (not shown) and 210. Load hot cantilever 212 and load neutral cantilever 214 are respectively connected to load hot terminal 116 and load neutral terminal 118. The other ends of the cantilevers are connected to doubled-sided contacts 216, 218. Receptacle terminals 120, 122 are connected to contacts 222, 224. When circuit interrupter 124 is in the tripped condition, the line contacts 208, 210 are electrically disconnected from load contacts 216, 218 and receptacle contacts 222, 224. In another embodiment, cantilevers 204, 206, 212 and 214 may be self-biased toward a tripped state. Springs may also be used to provide biasing.

The circuit interrupter 124 may be reset by depressing reset button 145. As reset button 145 is released, latch block 226 lifts cantilevers 204, 206, 212, and 214 in an upward direction until contacts 208, 210 electrically engage contacts 216, 218, and contacts 216, 218 electrically engage contacts 222, 224. In the reset state, of course, the respective hot and neutral line terminals, receptacle load terminals, and feed through load terminals are electrically connected.

Those of ordinary skill in the art will understand that the contacts used in the circuit interrupter and the auxiliary switch may be implemented using any suitable means including conductive plating, conductive portions of cantilever members, conductive portions of fixed or substantially fixed members, conductive protuberances, and/or any other suitable means for conducting electrical current from one member to another.

Circuit interrupter 124 remains reset until such time as a fault condition is detected and trip mechanism 142 decouples latch block 226 from cantilevers 204, 206. Once the latch block is decoupled from the cantilevers, the cantilevers move to their tripped positions in the described manner.

The mechanical implementation in accordance with one embodiment of the present invention is also depicted in FIG. 2. In particular, auxiliary switch 144 is implemented by movable cantilever 250 and fixed cantilever 254. Moveable cantilever 250 includes a contact 252, whereas fixed member 254 includes contact 256. Cantilever 250 and/or contact member 254 may be mounted to printed circuit board 200. In operation, when circuit interrupter 124 is reset, latch block 226 deflects cantilever 250 until contacts 252 and 256 engage each other to close the circuit and establish electrical connectivity. Cantilever member 254 may deflect when contact 252 applies force to contact 256. When the force applied to cantilever 250 is released, the switch opens. Note that cantilever 250 is self biased to return to the open position.

One feature of the present invention is that also protects device 10 in the event that auxiliary switch 144 itself is subject to various possible end of life conditions that prevent the protective device from being able to interrupt a fault condition. Examples of such conditions include the welding together of the auxiliary switch contacts to an extent that they cannot be physically separated by the trip mechanism. Another example is that a contact of the auxiliary switch is contaminated with an electrically non-conductive substance that prevents the switch contacts from being electrically connected. Another end of life condition relates to the wear and tear of the trip mechanism such that the auxiliary switch remains open when the interrupting contacts are closed. Yet another example of an end of life condition relates to the closure of the auxiliary switch being prevented (in the reset state) by the presence of dirt, or some other foreign matter. The auxiliary switch 144 may experience an end of life condition due to mechanical wear and tear.

The auxiliary switch is called upon to initiate and then maintain a current level through power supply 132 of typically 8 milliamperes when the device 10 is reset. The auxiliary switch is also used to conduct the current that energizes the solenoid, which is typically about 3 amperes. Of course, this current is present each time device 10 is tripped. Electronic components may be connected to auxiliary switch 144 to mitigate any electrical arcing that might contribute to an end of life condition. In one embodiment (See FIG. 1) this is implemented using a capacitor 152, which is connected in parallel with the auxiliary switch 144. Capacitor 152 serves to absorb energy when the contacts open, thus reducing the amount of energy available to form the arc. A resistor may be disposed in series with the capacitor (not shown).

As shown in FIG. 2, a secondary latch block 226' is included. An advantage for subdividing the latch block into two parts is that the second latch block includes portions disposed above one or more of the cantilevers whose purpose is to be described. On the other hand, latch block 226 includes portions disposed below the cantilevers. The two part latch block configuration permits the trip mechanism 142 portion to be manufactured in a top-down manner.

Latch block 226' ensures that contacts are capable of opening even if there is an end of life condition. Latch block 226' is configured to move in an upward direction in response to the upward motion of latch block 226 when circuit interrupter 124 is being reset. On the other hand, when circuit interrupter 124 trips, latch block 226 moves in a downward direction due to a downward force exerted by an at least one spring 260. The downward force is also applied to latch block 226'. Latch block 226' includes an arm 262 that applies a downward force on the auxiliary switch 144. The force is employed to open the auxiliary switch 144 if the self-biasing opening force in cantilever 250 because of one of the end of life conditions described above. Latch block 226' may include other arms 264, 266, 268, 270 that also apply downward forces to cantilevers 204, 206, 212, 214, respectively. Again, the applied force is configured to overcome dirt, foreign material, welding, or the like that may prevent the opening of the respective contacts when there is an end of life condition.

In an alternate embodiment, cantilever 250 is pre-biased such that auxiliary switch 144 is disposed in the closed position. Thus, switch 144 is opened by a force applied to it by latch blocks 226, 226'. Latch block 226, disposed beneath cantilever 250, moves in an upward direction during a reset action to close the auxiliary switch 144 if the self-biasing closing force in cantilever 250 is incapable of doing so. During tripping, arm 262 applies a downward force to open auxiliary switch 144.

Similarly, cantilevers 204, 206, 212, 214 may also be pre-biased such that their respective contacts are in the closed position if force is not applied to them by latch blocks 226, 226'. Latch block 226, disposed beneath the cantilevers, moves in an upward direction during a reset action to close the load contacts if the self-biasing closing forces in the cantilevers are incapable of doing so as a result of an end of life condition. During tripping, arms 264, 266, 268, 270 apply a downward force to open the load contacts.

Figure 3:
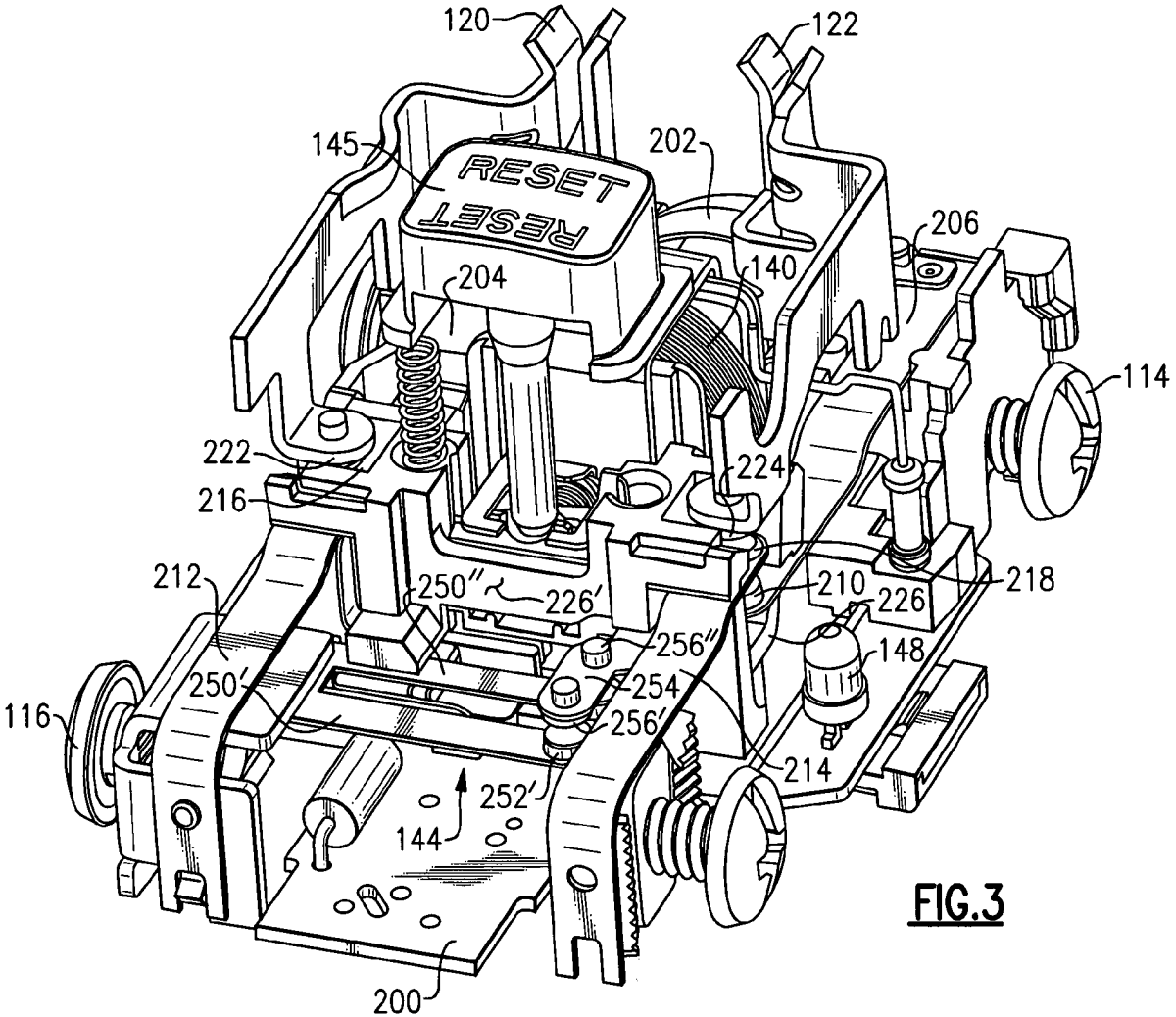
FIG. 3 is a perspective view of a mechanical embodiment of a wiring device in accordance with another embodiment of the present invention.

Referring to FIG. 3, a perspective view of a mechanical embodiment of a wiring device in accordance with another embodiment of the present invention is disclosed. The schematic shown in FIG. 1 is also applicable to the alternate embodiment. This embodiment is similar to that shown in FIG. 2 except that auxiliary switch 144 includes bifurcated contacts. Auxiliary switch 144 is closed when circuit interrupter 124 is reset and is open when the circuit interrupter is tripped. However, auxiliary switch 144 includes two cantilevers 250', 250" instead of a single cantilever 250. Cantilever 250' includes contact 252' and cantilever 250" includes a contact 252". Fixed member 254 includes contacts 256', 256" which are configured to mate with contacts 252' and 252". Cantilevers 250', 250" and/or contact member 254 are also mounted to printed circuit board 200.

In operation, when circuit interrupter 124 is being reset, latch block 226 deflects cantilevers 250', 250" until contact pairs 252', 256' and 252", 256" engage. Fixed member 254 may be configured to deflect somewhat when contacts 252', 252" engage contacts 256', 256". When circuit interrupter 124 is tripped, latch block 226 the force applied to cantilevers 250', 250" is released. Note that cantilevers 250', 250" are self-biased to return to the open position. Electrical connectivity need only be established between one contact pair in order for the auxiliary switch to be closed. Thus if an end of life condition prevents one pair of contacts from closing, the second contact pair permits the auxiliary switch to still be in an operative condition.

Figure 4:
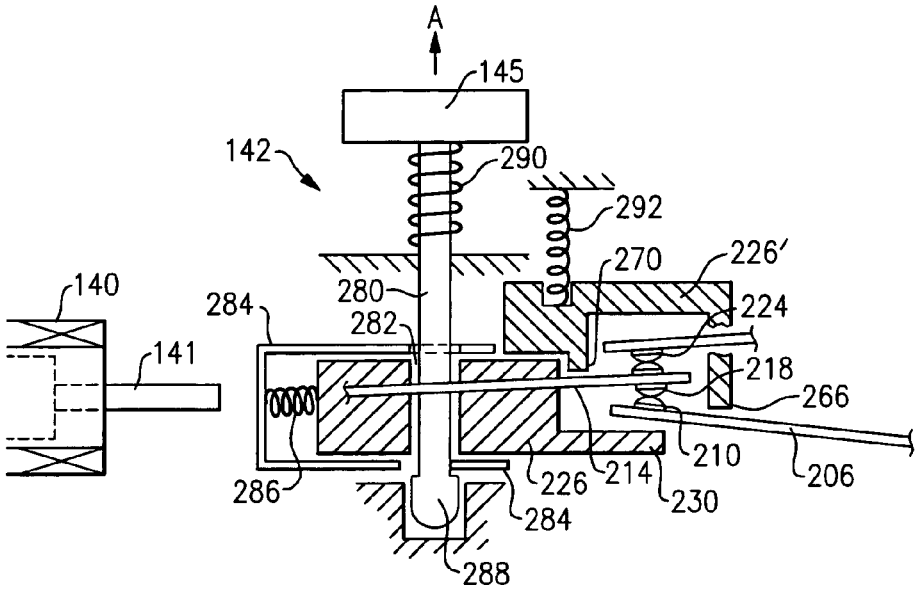
FIG. 4 is a detail view of the trip mechanism shown in FIG. 2.
Figure 5:
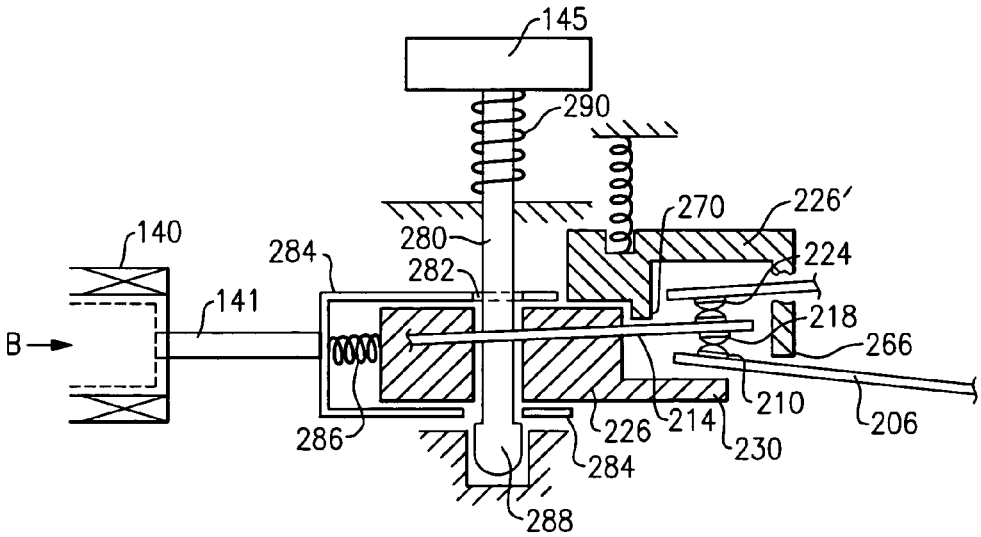
FIG. 5 is a detail view of the trip mechanism shown in FIG. 2.
Figure 6:
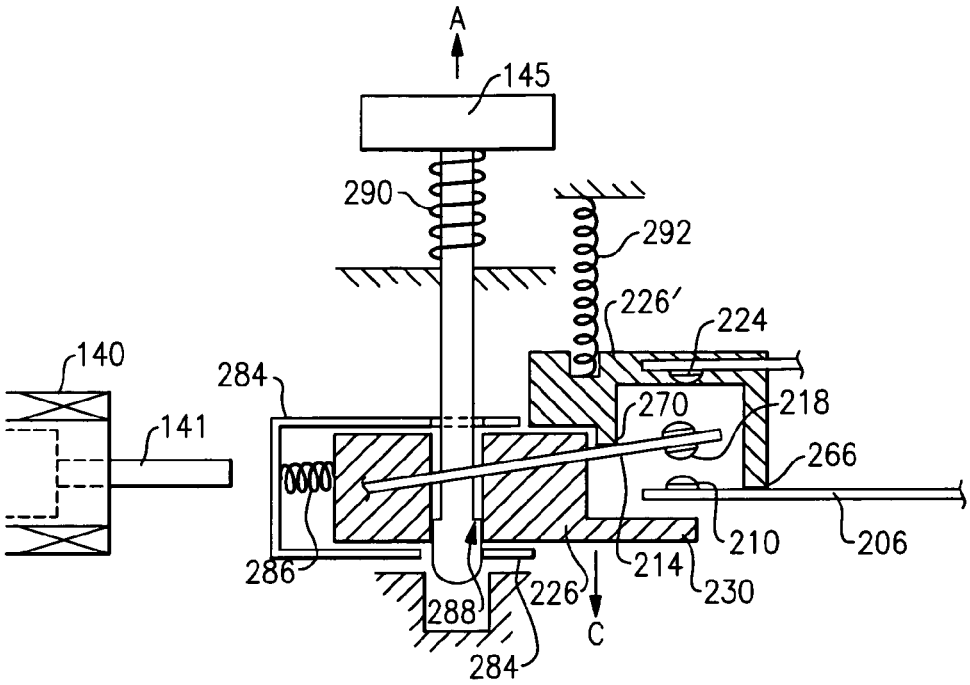
FIG. 6 is a detail view of the trip mechanism shown in FIG. 2.

Referring to FIGS. 4-6, a perspective view of the trip mechanism shown in FIGS. 2 and 3 is disclosed. For sake of clarity, FIGS. 4-6 illustrate the manner in which the trip mechanism 142 operates relative to the neutral terminals.

FIG. 4 depicts trip mechanism 142 in the reset condition. Reset button 145 includes a stem portion 280 that is slidable within hole 282 of latch block 226. Latch 284, return spring 286, and latch block 226 are pre-assembled to form a latch subassembly. Latch 284 is slidable relative to latch block 226. Spring 286 forces latch 284 to partially occlude hole 282. Thus, escapement 288 lifts latch block 226 upward to close contacts 210, 218, and 224 to effect a reset state.

In particular, when reset button 145 is depressed, stem 280 moves downward and the bulbous portion of stem 280 pushes latch 284 to the right until the bulbous portion is entirely through the hole in latch 284. Once the bulbous portion is through the hole in latch 284, latch 284 moves in a leftward direction, due to force exerted on it by spring 286, until the latch becomes seated on the escapement. When reset button 145 is released, it is directed in the upward direction, as indicated by directional arrow "A", by the force exerted on it by reset spring 290. Since latch 284 is seated on escapement 288, the latch and the two latch blocks 226, 226' are likewise directed upward.

Latch block 226 includes an arm 230 that deflects cantilever 206 that in turn deflects cantilever 214 until contacts 210, 218 come to rest on contact 224. Of course, the neutral line and load terminals are electrically connected when contacts 210, 218 and 224 are connected together.

FIG. 5 shows circuit interrupter 124 during the tripping process. Solenoid 140 is energized in response to a trip signal. In response, a magnetic force is exerted on armature 141 to move the armature in the direction indicated by directional arrow B. Armature 141 overcomes the force of spring 286 and pushes latch 284 to the right. When latch 284 is no longer seated on escapement 288, the bulbous portion of stem 280 becomes aligned with the hole in latch 284.

Referring to FIG. 6, when reset button 145 is no longer held back by escapement 288, it moves in direction A in response to the spring force exerted on button 145 by spring 290. Since the escapement 288 is no longer aligned with respect to latch 284, stem 280 and the bulbous portion move through the hole in latch 284 without escapement 288 reseating itself. Thus, latch 284 is decoupled from reset stem 280, and latch 284, and the two latch blocks 226, 226' move in a downward direction (See directional arrow "C") in response to the force exerted on latch block 226' by break spring 292. Cantilevers 206, 214 are also self-biased to move in direction C to the tripped state. Contacts 210, 218, and 224 are no longer connected. An additional spring may be included to move the cantilever to the open position (not shown.)

Figure 9:
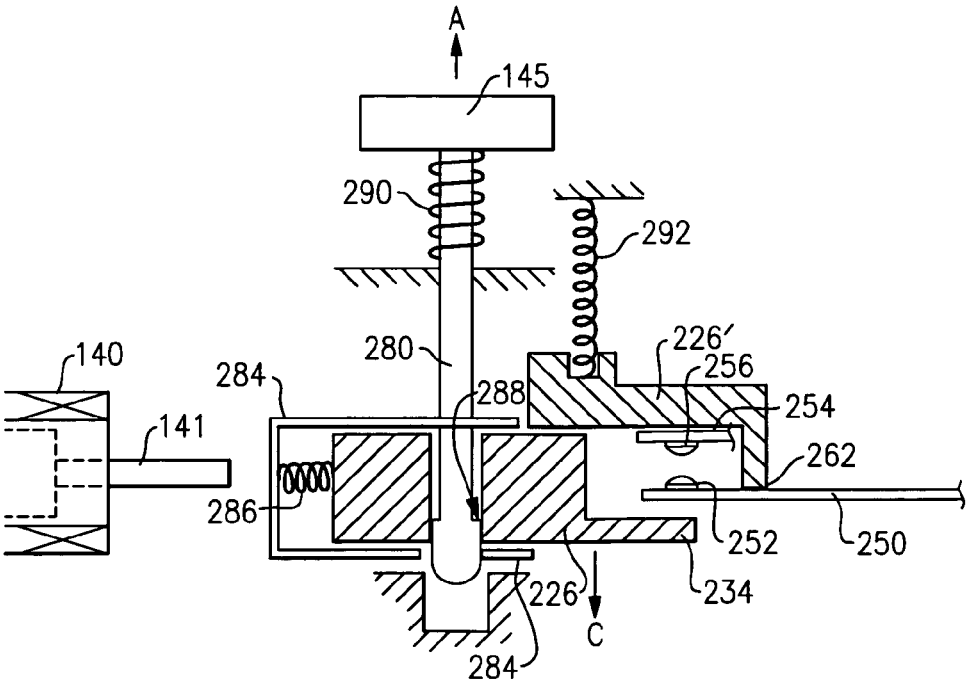
FIG. 9 is a detail view of the auxiliary switch shown in FIG. 2.
Figure 7:
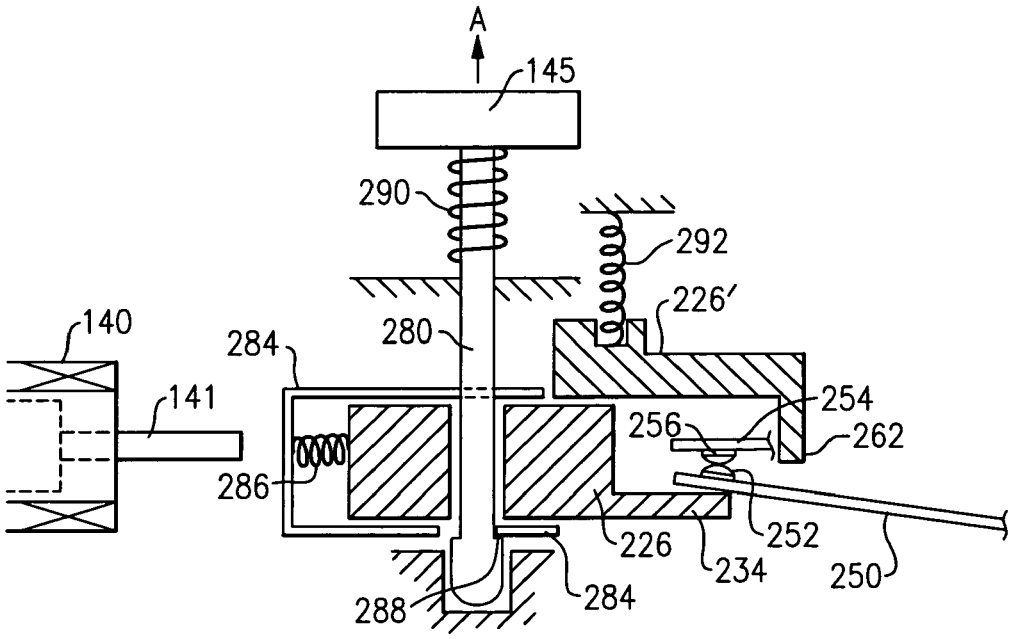
FIG. 7 is a detail view of the auxiliary switch shown in FIG. 2.
Figure 8:
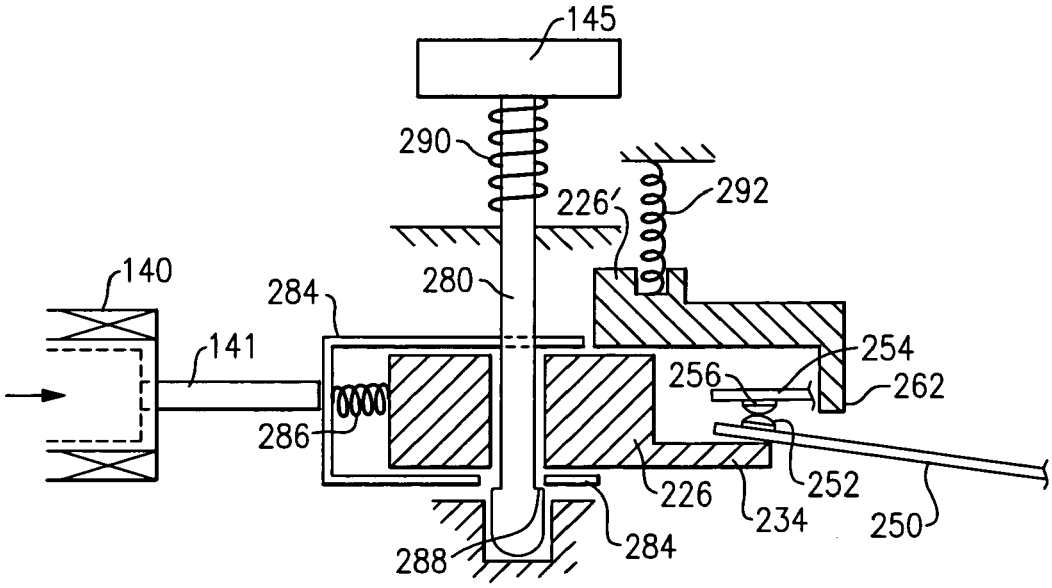
FIG. 8 is a detail view of the auxiliary switch shown in FIG. 2.

Referring to FIGS. 7-9, a detail view of the auxiliary switch shown in FIGS. 2 and 3 is disclosed. Latch block 226 includes an arm 234 that is configured to deflect cantilever 250. Cantilever 250 includes contact 252 which engages contact 256 when cantilever 250 is deflected. This occurs when circuit interrupter 124 is in a reset state.

FIG. 8 shows the auxiliary switch immediately prior to tripping, and therefore, shows auxiliary switch 145 at the same moment in time depicted in FIG. 5. Again, armature 141 overcomes the force of spring 286 and pushes latch 284 to the right. When latch 284 is no longer seated on escapement 288, the bulbous portion of stem 280 becomes aligned with the hole in latch 284.

FIG. 9 depicts the auxiliary switch immediately after tripping. Cantilever 250 may be pre-biased to move to the open position. As noted above, when the bulbous portion of stem 280 moves through the hole in latch 284, latch 284, latch block 226, and latch block 226' move in a downward direction. In one embodiment, latch block 226' may include an arm 262 which is configured to strike cantilever 250 as latch block 226' moves downwardly. The striking force is configured to separate contact 252 from contact 256 in the event that they become adhered to one another through a welding action or by some other means. Accordingly, arm 262 is an ancillary means for opening auxiliary switch 144 if the pre-biasing force alone in incapable of opening the auxiliary switch due to the occurrence of an end of life condition.

Note that the auxiliary switch 144 is configured to close before contacts 208, 216, 222 and 210, 218, 224 close. Otherwise, when the circuit interrupter 124 is being reset, the load terminals are live while the auxiliary switch is open. If the auxiliary switch is open, the trip solenoid 140 cannot energize to interrupt a fault condition. On the other hand, if the auxiliary switch is closed first, the protective device is functioning at the moment the load contacts close. The desired contact closing sequence is implemented by latch blocks 226, 226'. Latch block 226 guides the movable contacts 208, 210 and 252 from the open to the closed position by way of arms 230, 232 (not shown), and 234. Note the arm 232 is identical to arm 234, but it operates the cantilever in the hot conductive path. Stationary contact 256 may be disposed on latch block 226' in a fixed spatial relationship relative to contacts 222, 224. The excursion distances of the movable contacts are also in predetermined spatial relationship.

When the device is in the act of tripping, the auxiliary switch 144 may be configured to open after contacts 208, 216, 222 and 210, 218, 224 open. Normally the contacts open simultaneously under the guidance of trip mechanism 142. However, one or more load contact may be welded due to an end of life condition. Given this circumstance, arms 264, 266, 268, 270 may be positioned so as to break the welded condition to assure that the load terminals 116, 118, 120, 122 are disconnected from the line terminals 112, 114 before arm 262 acts to open auxiliary switch 144.

In an alternate embodiment the auxiliary switch 144 may be self-biased in the closed position, wherein arm 234 may be used as an ancillary method for closing the auxiliary switch. Thus auxiliary switch 144 is closed before arms 230, 232 proceed to close the load contacts 208, 210.

As noted previously, the contacts normally open under the guidance of trip mechanism 142. However, one or more load contact may be welded due to an end of life condition. Given this circumstance, arms 264, 266, 268, 270 are configured to break the welded condition to assure that the load terminals 116, 118, 120, 122 are disconnected from the line terminals 112, 114 before arm 262 acts to open auxiliary switch 144.

Reference is made to U.S. application Ser. No. 10/900,769 and U.S. application Ser. No. 10/953,805, which are incorporated herein by reference as though fully set forth in its entirety, for a more detailed explanation of circuit interrupter configurations employed by the present invention.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A protective device comprising:

a plurality of line terminals;

a plurality of load terminals;

a fault detection assembly coupled to the plurality of line terminals, the fault detection circuit being configured to provide a fault detection output in response to detecting a fault condition;

a circuit interrupter coupled between the plurality of line terminals and the plurality of load terminals, the circuit interrupter including a first set of contacts, the first set of contacts being configured to close to establish at least one electrically continuous path between the plurality of line terminals and the plurality of load terminals in a reset state, the first set of contacts being configured to open to disconnect the at least one electrically continuous path in response to the fault detection output to enter a tripped state;

an auxiliary switch coupled to the fault detection assembly, the auxiliary switch including a second set of contacts configured to decouple at least a portion of the fault detection assembly from a source of electrical power in the tripped state; and a latch block assembly coupled to the circuit interrupter, the latch block assembly including a first latch block mechanism and a second latch block mechanism, the first latch block mechanism and the second latch block mechanism being conjointly movable together between the reset state and the tripped state, the first latch block mechanism being configured to urge the first set of contacts to close when transitioning from the tripped state to the reset state, the second latch block mechanism being configured to urge the second set of contacts open when transitioning from the reset state to the tripped state.

2. The device of claim 1, wherein the plurality of load terminals include a plurality of feed-through terminals and a plurality of receptacle terminals.

3. The device of claim 2, wherein the at least one electrically continuous path includes at least one electrically continuous path between the plurality of line terminals, the plurality of feed-through terminals, and the plurality of receptacle terminals, the plurality of feed-through terminals being electrical decoupled from the plurality of receptacle terminals in the tripped state, the first set of contacts including at least one line contact, at least one feed-through contact, and at least one receptacle terminal contact.

4. The device of claim 2, wherein the at least one electrically continuous path includes at least one first electrically continuous path between the plurality of line terminals and the plurality of feed-through terminals, and at least one second electrically continuous path between the plurality of line terminals and the plurality of receptacle terminals, at least one of the plurality of feed-through terminals being electrical decoupled from at least one of the plurality of receptacle terminals in the tripped state.

5. The device of claim 1, wherein the second set of contacts includes a cantilever having a moveable contact disposed thereon and a fixed member having a fixed contact disposed thereon, the latch block assembly being configured to close the second set of contacts by deflecting the cantilever towards the fixed member such that the moveable contact engages the fixed contact.

6. The device of claim 5, wherein the cantilever is intrinsically biased to deflect toward the fixed member such that the moveable contact engages the fixed contact.

7. The device of claim 1, wherein the second set of contacts includes a cantilever having a moveable contact disposed thereon and a fixed member having a fixed contact disposed thereon, the second latch block mechanism being configured to open the second set of contacts by deflecting the cantilever away from the fixed member such that the moveable contact disengages the fixed contact.

8. The device of claim 7, wherein the cantilever is intrinsically biased to deflect away from the fixed member such that the moveable contact disengages the fixed contact.

9. The device of claim 1, wherein the second set of contacts includes a cantilever member having a first contact disposed thereon and a substantially fixed member having a second contact disposed thereon, the latch block assembly being configured to close the second set of contacts by deflecting the cantilever towards the substantially fixed member such that the first contact engages the second contact, whereby the substantially fixed contact is deflected.

10. The device of claim 1, wherein the latch block assembly is configured to close the second set of contacts before the first set of contacts is closed when transitioning from the tripped state to the reset state.

11. The device of claim 1, wherein the auxiliary switch includes a cantilever member having a first contact disposed thereon and a substantially fixed member having a second contact disposed thereon, the second set of contacts including the first contact and second contact, the cantilever member being intrinsically biased to close the second set of contacts in the reset state.

12. The device of claim 11, wherein the latch block assembly directs the cantilever to close the second set of contacts in the reset state.

13. The device of claim 12, wherein the latch block assembly directs the cantilever to open the second set of contacts in the tripped state.

14. The device of claim 1, wherein the auxiliary switch includes a cantilever member having a first contact disposed thereon and a substantially fixed member having a second contact disposed thereon, the second set of contacts including the first contact and second contact, the cantilever member being intrinsically biased to open the second set of contacts in the tripped state.

15. The device of claim 14, wherein the latch block assembly directs the cantilever to open the second set of contacts in the tripped state.

16. The device of claim 14, wherein the latch block assembly directs the cantilever to close the second set of contacts in the reset state.

17. The device of claim 1, wherein the second set of contacts includes bifurcated contacts.

18. The device of claim 17, wherein the second set of contacts includes a bifurcated cantilever member having a first cantilever contact and a second cantilever contact disposed thereon and a substantially fixed member having a first fixed contact and a second fixed contact disposed thereon, the first fixed contact being aligned with the first cantilever contact and the second fixed contact being aligned with the second cantilever contact.

19. The device of claim 1, further comprising a latching member configured to couple the circuit interrupter and the latch block assembly in the reset state, the latching member being configured to decouple the circuit interrupter and the latch block assembly in response to the fault detection output.

20. The device of claim 19, wherein the latching member further comprises:

a reset button;

a plunger member coupled to the reset button, the plunger member being configured to be inserted into the latch block assembly, the plunger member including an escapement configured to couple the plunger to the latch block assembly in the reset state; and a spring element disposed about the plunger member, the spring element providing a biasing force that tends to urge the reset button away from the latch block assembly.

21. The device of claim 1, wherein the circuit interrupter includes at least one interrupter cantilever member aligned with at least one interrupter fixed member, the first set of contacts including at least one moveable interrupter contact disposed on the at least one interrupter cantilever member and at least one fixed interrupter contact disposed on the at least one interrupter fixed member.

22. The device of claim 21, wherein the at least one interrupter cantilever member is intrinsically biased in the open position.

23. The device of claim 21, wherein the at least one interrupter cantilever member is intrinsically biased in the closed position.

24. The device of claim 21, wherein the at least one interrupter cantilever member includes a hot cantilever member and a neutral cantilever member and the at least one interrupter fixed member includes corresponding hot fixed members and neutral fixed members.

25. The device of claim 1, wherein an indicator is coupled to the auxiliary switch.

26. The device of claim 25, wherein the indicator is a trip indicator.

27. The device of claim 25, wherein the indicator emits a visual or an audible indication.

28. The device of claim 27, wherein the indication is a repetitive indication.

29. The device of claim 1, wherein the fault detection assembly further comprises:

a fault detection circuit configured to detect the fault condition and transmit a fault detect signal in response thereto;

an SCR coupled to the fault detection circuit, the SCR being turned ON in response to the fault detect signal; and a solenoid coupled to the SCR, the solenoid providing the fault detection output in response to the SCR being ON.

30. The device of claim 24, wherein the fault condition includes an end of life condition.

31. The device of claim 30, wherein the end of life condition includes a short circuit condition in the SCR.

32. The device of claim 30, wherein the end of life condition includes an inoperative fault detection circuit.

33. The device of claim 30, wherein the end of life condition includes a malfunctioning solenoid.

34. The device of claim 30, wherein the end of life condition includes an inoperative auxiliary switch.

35. The device of claim 1, wherein the fault condition includes at least one of a simulated fault, a ground fault, a grounded neutral fault, or an arc fault condition.

36. The device of claim 1, further comprising a MOV in series with the auxiliary switch.

37. The device of claim 1, wherein the second latch block mechanism includes an arm configured to apply a force on the auxiliary switch to open the second set of contacts.

38. A protective device comprising:

a plurality of line terminals;

a plurality of load terminals;

a fault detection assembly coupled to the plurality of line terminals, the fault detection circuit being configured to provide a fault detection output in response to detecting a fault condition;

a circuit interrupter coupled between the plurality of line terminals and the plurality of load terminals, the circuit interrupter including a first set of contacts, the first set of contacts being configured to close to establish at least one electrically continuous path between the plurality of line terminals and the plurality of load terminals in a reset state, the first set of contacts being configured to open to disconnect the at least one electrically continuous path in response to the fault detection output to enter a tripped state, the first set of contacts being biased toward the tripped state;

an auxiliary switch coupled to the fault detection assembly, the auxiliary switch including a second set of contacts configured to decouple at least a portion of the fault detection assembly from a source of electrical power after the circuit interrupter has entered the tripped state, the second set of contacts being biased toward the reset state;

a latch block assembly coupled to the circuit interrupter, the latch block assembly including a first portion configured to close the first set of contacts when transitioning from the tripped state to the reset state and a second portion configured to open the second set of contacts when transitioning from the reset state to the tripped state; and a user-accessible reset mechanism coupled between the circuit interrupter and the latch block assembly, the user-accessible reset mechanism being configured to close the first set of contacts and close the second set of contacts in a predetermined sequence when transitioning from the tripped state to the reset state.

39. The device of claim 38, wherein the second set of contacts are closed before the first set of contacts are closed when transitioning from the tripped state to the reset state.

40. The device of claim 38, wherein the user-accessible reset mechanism further comprises:

a reset button;

a plunger member coupled to the reset button, the plunger member being configured to be inserted into the latch block assembly, the plunger member including an escapement configured to couple the plunger to the latch block assembly in the reset state; and a first spring element disposed about the plunger member, the spring element providing a spring biasing force that tends to urge the reset button away from the latch block assembly.

41. The device of claim 40, wherein the first portion further comprises:

a hole aligned with the plunger member;

a second spring member coupled to the hole and the fault detection assembly, the second spring member being moveable between a first spring state and a second spring state in response to the fault detection output; and a latch member disposed in the hole and mechanically coupled to the second spring, the latch member being configured to partially occlude the hole in the first spring state, the escapement being configured to engage the latch member in the first spring state to effect the reset state, the latch member being configured to not occlude the hole in the second spring state such that the escapement disengages the latch member to effect the tripped state.

42. The device of claim 41, wherein the second portion moves in unison with the first portion.

43. A protective device comprising:

a plurality of line terminals;

a plurality of load terminals;

a fault detection assembly coupled to the plurality of line terminals, the fault detection circuit being configured to provide a fault detection output in response to detecting a fault condition;

a circuit interrupter coupled between the plurality of line terminals and the plurality of load terminals, the circuit interrupter including a first set of contacts, the first set of contacts being configured to close to establish at least one electrically continuous path between the plurality of line terminals and the plurality of load terminals in a reset state, the first set of contacts being configured to open to disconnect the at least one electrically continuous path in response to the fault detection output to enter a tripped state;

an auxiliary switch coupled to the fault detection assembly, the auxiliary switch including a second set of contacts that include a moveable contact disposed on a cantilever and a fixed contact disposed on a substantially fixed member, the cantilever being deflected away from the fixed member to open the auxiliary switch and decouple at least a portion of the fault detection assembly from a source of electrical power when transitioning from the reset state to the tripped state; and a latch block assembly coupled to the circuit interrupter and the auxiliary switch, the latch block assembly being configured to move along a vertical linear axis between the reset state and the tripped state, the latch block assembly also being configured to deflect the cantilever to the open or closed position.

44. The device of claim 43, wherein the cantilever is intrinsically biased to close the second set of contacts.

45. The device of claim 43, wherein the cantilever is intrinsically biased to open the second set of contacts.

46. The device of claim 43, wherein the fault condition includes at least one of a simulated fault, a ground fault, a grounded neutral fault, or an arc fault condition.

47. The device of claim 43, further comprising a MOV in series with the auxiliary switch.

48. The device of claim 43, wherein an indicator is coupled to the auxiliary switch.

49. A protective device comprising:

a plurality of line terminals;

a plurality of load terminals;

a fault detection assembly coupled to the plurality of line terminals, the fault detection circuit being configured to provide a fault detection output in response to detecting a fault condition;

a circuit interrupter coupled between the plurality of line terminals and the plurality of load terminals, the circuit interrupter including a first set of contacts, the first set of contacts being configured to close to establish at least one electrically continuous path between the plurality of line terminals and the plurality of load terminals in a reset state, the first set of contacts being configured to open to disconnect the at least one electrically continuous path in response to the fault detection output to enter a tripped state;

an auxiliary switch coupled to the fault detection assembly, the auxiliary switch including a second set of contacts that include moveable contacts disposed on a bifurcated cantilever member and fixed contacts disposed on a substantially fixed member, the bifurcated cantilever being deflected away from the fixed member to open the auxiliary switch and to decouple at least a portion of the fault detection assembly from a source of electrical power when transitioning from the reset state to the tripped state, the bifurcated cantilever being intrinsically biased to close the second set of contacts; and a latch assembly configured to deflect the bifurcated cantilever to the closed position wherein one or both of the moveable contacts are in electrical engagement with the corresponding fixed contacts, or to the open position in the tripped state.

50. The device of claim 49, wherein the cantilever is intrinsically biased to open the second set of contacts.

51. The device of claim 49, wherein the fault condition includes at least one of a simulated fault, a ground fault, a grounded neutral fault, or an arc fault condition.

52. The device of claim 49, further comprising a MOV in series with the auxiliary switch.

53. The device of claim 49, wherein an indicator is coupled to the auxiliary switch.

* * * * *